US009364966B2

(12) United States Patent
Niizeki et al.

(10) Patent No.: US 9,364,966 B2
(45) Date of Patent: Jun. 14, 2016

(54) CUTTING PLOTTER

(71) Applicants: Tomoyasu Niizeki, Ichinomiya (JP); Junnosuke Matsuda, Nagoya (JP)

(72) Inventors: Tomoyasu Niizeki, Ichinomiya (JP); Junnosuke Matsuda, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 218 days.

(21) Appl. No.: 13/847,873

(22) Filed: Mar. 20, 2013

(65) Prior Publication Data

US 2013/0247736 A1 Sep. 26, 2013

(30) Foreign Application Priority Data

Mar. 22, 2012 (JP) ..... 2012-065487

(51) Int. Cl.
*B26D 7/00* (2006.01)
*B26D 5/06* (2006.01)
*B26F 1/38* (2006.01)

(52) U.S. Cl.
CPC ..... *B26D 7/0006* (2013.01); *B26D 5/06* (2013.01); *B26F 1/3806* (2013.01); *Y10T 83/647* (2015.04); *Y10T 83/6579* (2015.04)

(58) Field of Classification Search
CPC ..... Y10T 83/6579; Y10T 83/647; Y10T 83/8821; Y10T 83/8822; Y10T 83/8854; B26D 1/18; B26D 7/00; B26D 7/006; B26D 2007/005; B26D 2007/0068; B26D 5/00; B26D 5/02; B41J 11/00; B41J 11/70; B41J 11/706
USPC ..... 83/422, 401, 613, 614, 636
See application file for complete search history.

(56) References Cited

U.S. PATENT DOCUMENTS

| | | | | |
|---|---|---|---|---|
| 6,315,474 | B1 * | 11/2001 | Giles et al. | 400/621 |
| 6,341,548 | B1 | 1/2002 | Hirahata et al. | |
| 6,997,095 | B1 * | 2/2006 | Kishi et al. | 83/881 |
| 7,124,670 | B2 * | 10/2006 | Tanaka et al. | 83/62 |
| 7,204,654 | B2 * | 4/2007 | Ahne et al. | 400/621 |
| 7,815,382 | B2 * | 10/2010 | Monclus et al. | 400/621 |

FOREIGN PATENT DOCUMENTS

JP 2000-000797 A 1/2000

* cited by examiner

*Primary Examiner* — Phong Nguyen
(74) *Attorney, Agent, or Firm* — Fox Rothschild LLP

(57) ABSTRACT

A cutting plotter includes a conveying mechanism, a guide shaft, a cutting head, a cutter moving mechanism, and a slidable contact. The conveying mechanism is configured to convey a sheet-like object in a first direction and includes one roller shaft and a driving roller. The roller shaft includes two rollers located at different positions. The conveying mechanism is configured to convey the object held between the rollers and the driving roller. The cutting head is slidably supported by the guide shaft and configured to be mounted with a cutter. The slidable contact is located in the cutting head and contacts the roller shaft between the rollers of the roller shaft so as to be slidable, maintaining a position of the cutting head. The slidable contact has a U-shaped cross section, and the roller shaft is disposed at an open side of the U-shape.

6 Claims, 7 Drawing Sheets

CUTTING PLOTTER

CROSS-REFERENCE TO RELATED APPLICATIONS

This application claims priority to Japanese Patent Application No. 2012-65487 filed on Mar. 22, 2012, the content of which is hereby incorporated herein by reference in its entirety.

BACKGROUND

1. Technical Field

The present disclosure relates to a cutting plotter that includes a conveying mechanism to convey a sheet-like cutting object and a cutter to cut the cutting object.

2. Description of Related Art

Conventionally, a cutting plotter has been known. The cutting plotter automatically cuts a sheet-like cutting object, i.e., a paper, to a predetermined shape based on cutting data The cutting plotter includes a conveying mechanism and a cutting head. The conveying mechanism convoys a cutting object to a front-rear direction, which is also referred to as a Y direction. The cutting plotter moves the cutting head that includes a cutter in a right-left direction, which is also referred as an X direction, along a guide shaft in synchronization with the conveying mechanism to cut a cutting object to a desirable shape.

The cutting plotter includes a mechanism to maintain a position of the cutting head to prevent the cutting from rotating. Conventionally, a guide plate is provided in a frame. The guide plate extends to the right-left direction, which is also parallel to the guide shaft, and has an L-shape in a side view. A sliding member and a sliding roller are provided in a rear surface of a carriage of the cutting head. The sliding member and the sliding roller pinch a front portion of the guide plate in the front-rear direction. The sliding member and the sliding roller prevent the rotation of the cutting head.

However, in the conventional cutting plotter, a guide plate was indispensable to prevent the rotation of the cutting head. The guide plate increases as number of members that form the cutting plotter and requires a space to he provided with the guide plate. Therefore, improvements of the mechanism to maintain a position of the cutting head are desired in view of a simple structure and saving space.

SUMMARY

The purpose of the present disclosure is to provide a cutting plotter that moves the cutting head along the guide shaft and has a simple structure to maintain a position of the cutting head.

A cutting plotter includes a housing, a conveying mechanism, a guide shaft, a cutting head, a cutter moving mechanism, and a slidable contact. The conveying mechanism is configured to convey a sheet-like cutting object to a first direction. The conveying mechanism is provided with one roller shaft extending in a second direction and driving roller intersecting with the first direction. The roller shaft is provided with two rollers located at different positions in the second direction. The conveying mechanism is configured to convey the object while the object is held between the rollers and the driving roller. The guide shaft extends in the second direction parallel to the roller shaft and is connected to the housing. The cutting head is supported by the guide shaft and is configured to be mounted with a cutter. A cutter moving mechanism is configured to move the cutting head along the guide shaft. The slidable contact is provided in the cutting head and the contacts the roller shaft between the rollers of the roller shaft, thereby maintaining a position of the cutting head. The slidable contact has a U-shaped cross section. The roller shaft is disposed at an open side of the U-shape. The slidable contact is disposed at a side opposed to the driving roller with the roller shaft being interposed therebetween.

DETAILED DESCRIPTION

Figure 1:
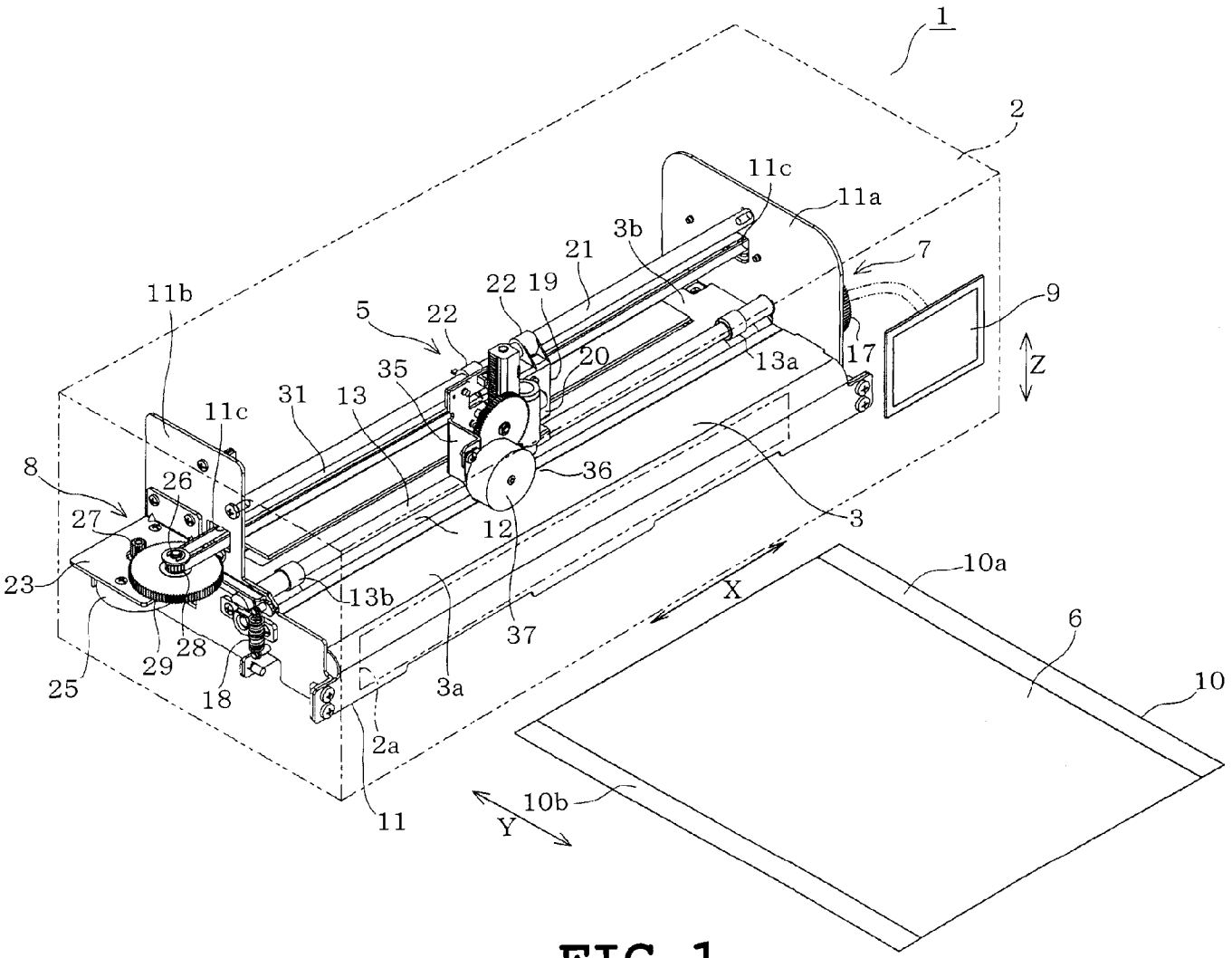
FIG. 1 is a perspective view of a cutting plotter according to one configuration, showing an inner structure thereof.

One configuration will be described with reference to the drawings. Referring to FIG. 1, a cutting plotter 1 serving as a cutting apparatus includes a body cover 2, a housing 11 provided in the body cover 2, a platen 3 mounted to the housing 11 and a cutting head 5 having a cutter 4 (see FIG. 7). The body cover 2 is formed into the shape of a horizontally long rectangular box and has a front formed with a horizontally long paper feed opening 2*a*. A sheet-like cutting object 6 to be cut, such as paper, is inserted through the paper teed opening 2*a* to be set on the platen 3 while being held by a holding sheet 10, as will be described in detail later.

The cutting plotter 1 includes a conveying mechanism 7 which conveys the cutting, object 6 in a front-back direction serving as a first direction, that is, in the Y direction. The cutting plotter 1 also includes a cutter moving mechanism 8 which moves the cutting head 5 in a right-left direction crossing or perpendicular to the conveying direction of the cutting object 6, that is, in the X direction. Constructions of the conveying mechanism 7, the cutter moving mechanism 8 and the cutting head 5 for cutting the cutting object 6 will be described in detail later.

On a right part of the front of the body cover 2 are provided a full-color liquid crystal display (LCD) 9 and an operation device 65 which includes a plurality of operation switches (see FIG. 9) and serves as an input unit for the user to supply various instructions, selections and inputs to the cutting plotter 1. The LCD 9 is configured as a display unit displaying various patterns, various messages for the user, and the like. Operation of the operation device 65 or the operation switches realizes selection of a pattern displayed on the LCD 9, set of various parameters, instruction of functions and the like.

Figure 2:
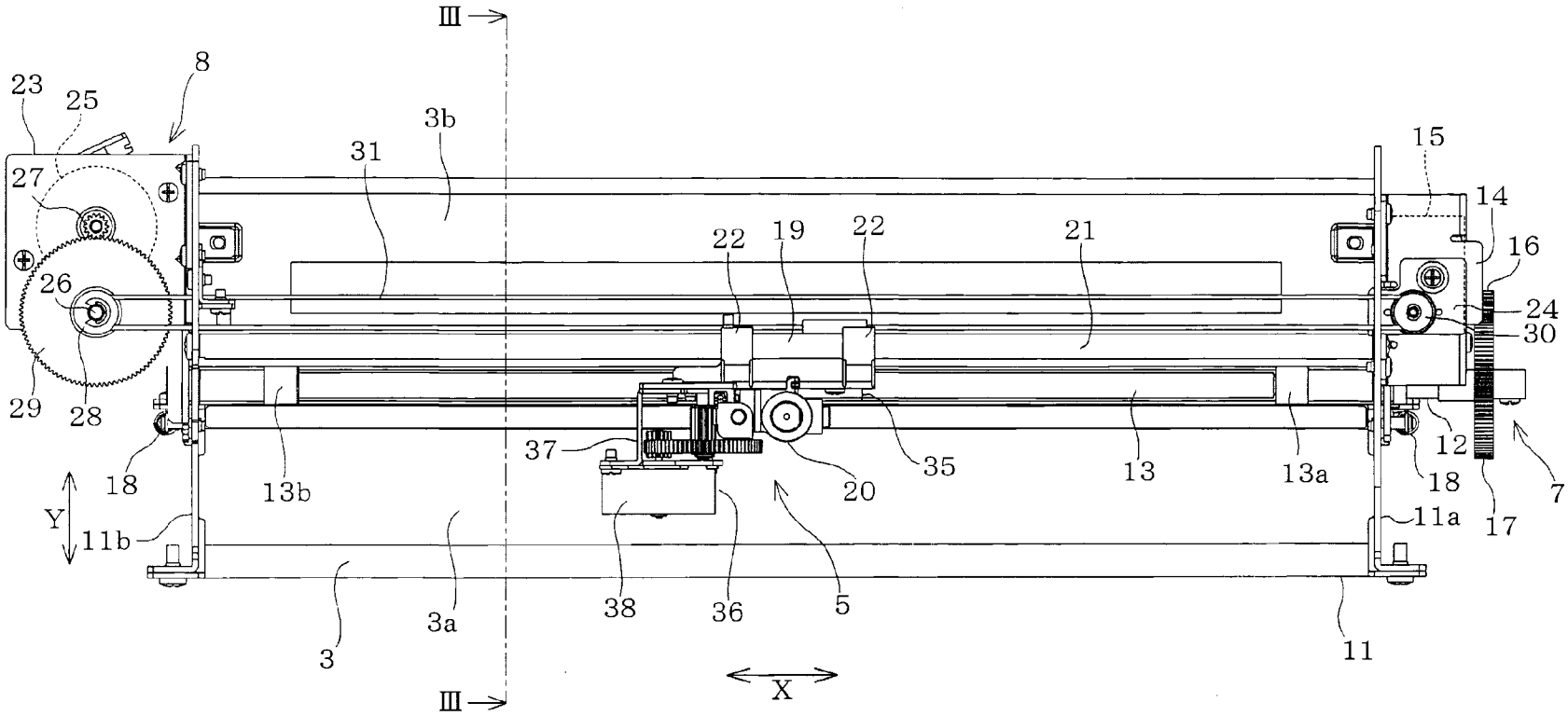
FIG. 2 is a plan view of the cutting plotter, showing the inner structure thereof.
Figure 3:
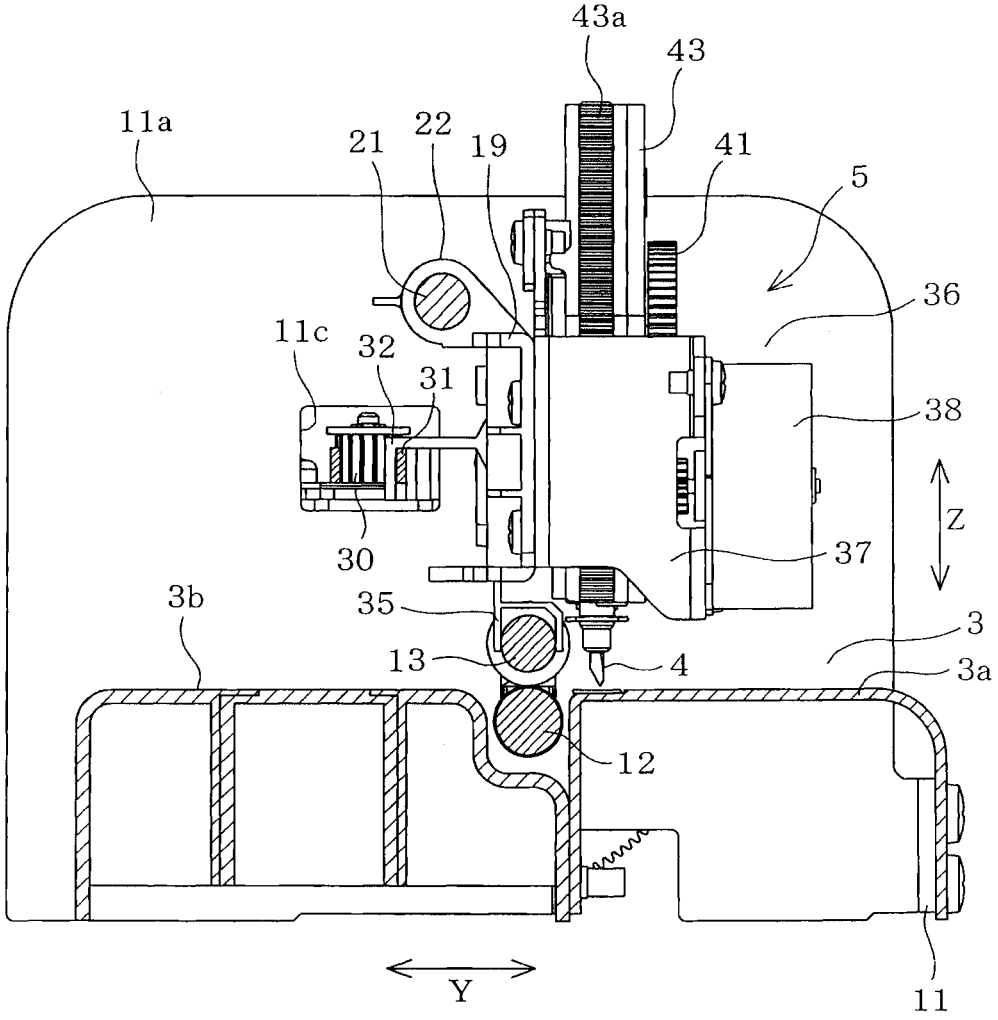
FIG. 3 is a longitudinally sectional left side view taken along line III-III in FIG. 2.
Figure 4:
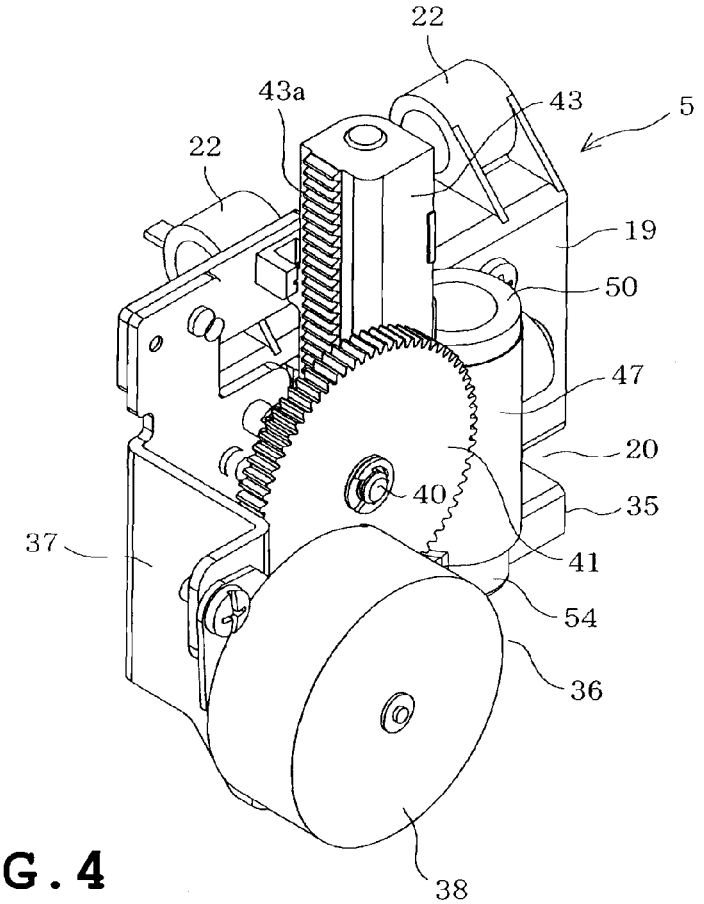
FIG. 4 is a perspective view of a cutting head.

The platen 3 is configured to receive the underside of the holding sheet 10 when the cutting object 6 is cut. The platen 3 includes a pair of front and rear plate members 3*a* and 3*b* as shown in FIGS. 2 and 3 as well as in FIG. 1. The platen 3 has an upper surface which is formed into a horizontal plane, and the cutting object 6 is conveyed with the holding sheet 10 holding the cutting object 6 being placed on the upper surface of the platen 3.

The holding sheet 10 is made of, for example, a synthetic resin and formed into a flat rectangular plate shape, as shown in FIG. 1. The holding sheet 10 has an adhesive layer formed by applying an adhesive agent to the upper surface thereof more specifically, on an inner area thereof except for right and left edges 10*b* and 10*a*. The cutting object 6 is adapted to be affixed to the adhesive layer thereby to be held. An X-Y coordinate system with a left corner serving as an origin O, for example, is set on the holding sheet 10. Cutting data is set based on the X-Y coordinate system.

The conveying mechanism 7 is configured as follows. The housing 11 includes right and left sidewalls 11*a* and 11*b* which are located on the right and left sides of the platen 3 so as to be opposed to each other as shown in FIGS. 1, 2 and the like. A driving, roller 12 and a pinch roller shaft 13 serving as a roller shall are provided between the sidewalk 11*a* and 11*b* so as to be located in a space between the front and rear platens 3*a* and 3*b* as shown in FIG. 3 as well as FIGS. 1 and 2. The driving, roller 12 and the pinch roller shaft 13 both extend in the right-left or X direction and are provided so as to be arranged horizontally in the up-down direction in parallel to each other. In this case, the driving roller 12 is located lower and the pinch roller 13 is located higher than the driving roller 12.

The driving roller 12 has an upper end which is substantially level with the upper surface of the platen 3 and right and left end sides which are rotatably supported on the sidewalls 11*a* and 11*b* respectively as shown in FIG. 3. With this, the right end of the driving roller 12 extends rightward through the right sidewall 11*b* and has a distal end to which a driven gear 17 with a larger diameter is secured, as shown in FIG. 2. A mounting frame 14 is mounted to an outside of the right sidewall 11*a* as shown in FIG. 2. A Y-axis motor 1 such as a stepping motor is mounted on the mounting frame 14. The Y-axis motor 15 includes an output shaft to which a driving gear 16 with a smaller diameter is fixed to be in mesh engagement with the driven gear 17. Consequently, normal or reverse rotation of the Y-axis motor 15 drives the driving, roller 12 so that the driving roller 12 is rotated in the normal or reverse direction.

The pinch roller shaft 13 has right and left ends which are supported on the respective sidewalls 11*a* and 11*b* so as to be rotatable and so as to he displaceable by a slight amount in an up-down direction or a third direction. The cutting object 6 has a thickness direction also corresponding with the up-down direction. Two extension coil springs 18 are mounted between the right and left ends of the pinch roller 13 and the sidewalls 11*a* and 11*b* outside the sidewalls 11*a* and 11*b* respectively. As a result, the pinch roller shaft 13 is normally biased downward or to the driving, roller 12 side. Furthermore, the pinch roller shaft 13 is provided with two rollers 13*a* and 13*b* which are located near the right and left ends of the pinch roller shaft 13 and have slightly larger diameters, respectively, as shown in FIGS. 1 and 2.

The right and left edges 10*a* and 10*b* of the holding sheet 10 are thus held between the driving roller 12 and the respective rollers 13*a* and 13*b* of the pinch roller shaft 13. The conveying mechanism 7 holds the holding sheet 10 between the driving roller 12 and the rollers 13*a* and 13*b* of the pinch roller shaft 13. The Y-axis motor 15 is driven to rotate the driving roller 12, thereby conveying the holding sheet 10 freely in the front-back direction or the Y direction while being held in the above-described manner.

The cutter moving mechanism 8 is constructed as follows. A guide shaft 21 is mounted between the sidewalls 11*a* and 11*b* of the housing 11 so as to be located in the upper rear of the pinch roller shaft 13 or at the downstream side in the conveying direction of the cutting object 6, as shown in FIGS. 1 to 3. The guide shall 21 extends in the right-left direction or the X direction substantially in parallel with the pinch roller shaft 13. The cutting head 5 includes a carriage 19 located at the back side thereof as shown in FIGS. 4 to 8 as well as FIGS. 1 to 3. The carriage 19 is provided with right and left guide cylinders 22 inserted through the guide shaft 21. As a result, the carriage 19 and accordingly the cutting head 5 are movable along the guide shaft 21 in the right-left or X direction.

A horizontal mounting plate 23 is mounted to the outer rear of the left sidewall 11*b* as shown in FIGS. 1 and 2. With this, an auxiliary mounting plate 24 is mounted to the outer rear of the right sidewall 11*a* as shown in only FIG. 2. An X-axis motor 25 such as a stepping motor s mounted on the underside of the mounting plate 23 so as to be directed upward or so that an output shaft thereof extends vertically. A vertically extending pulley shaft 26 is rotatably mounted on an upper surface of the mounting plate 23. A driving gear 27 having a smaller diameter is fixed to the output shall of the X-axis motor 25. A timing pulley 28 and a driven gear 29 having a larger diameter are rotatably mounted on the pulley shall 26. The timing pulley 28 and the driven gear 29 are formed integrally with each other and are accordingly rotated together. The driven gear 29 is in mesh engagement with the driving gear 27.

A timing pulley 30 is rotatably mounted on the auxiliary mounting plate 24 so that an axis thereof extends in the up-down direction, as shown in FIG. 2. An endless timing belt 31 extends horizontally in the X direction between the timing pulleys 30 and 28 as shown in FIGS. 1 to 3. The timing belt 31 has a middle portion connected to a mounting portion 32 mounted on the rear of the carriage 19 as shown in FIG. 3. The sidewalk 11*a* and 11*b* include portions formed with rectangular openings 11*c* through which the timing belt 31 passes, respectively. As the result of the above-described construction, when the X-axis motor 25 is rotated in the normal or reverse direction, a generated rotative force or torque is transmitted via the driven gear 29 and the timing pulley 28 to the timing belt 31, whereby the carriage 19 and accordingly the cutting head 5 are moved freely in the right-left direction.

The cutting head 5 includes a cutter holder 20 which is located at the right front side of the carriage 19 to hold the cutter 4, and a drive mechanism 36 which is located on the left of the cutter holder 20 to move the cutter holder 20 (the cutter 4) upward and downward. The construction of the cutting head 5 will now be described with reference to FIGS. 3 to 8 as well as FIGS. 1 and 2. The carriage 19 is formed into the shape of a horizontally long substantially rectangular plate as viewed at the front, as shown in FIGS. 3, 8 and the like. The carriage 19 includes the right and left guide cylinders 22 located on the right and left portions of the top thereof respectively and a mounting portion 32 located on the rear thereof.

The carriage 19 is provided with a vertically extending first engagement portion 33 which is located on a slightly left part of the front thereof as shown in FIG. 8 and formed into an L-shape on a planar view. The carriage 19 is also provided with a vertically extending second engagement portion 34 located on a generally central part of the front thereof. The cutter holder 20 includes first and second engaged portions with which the first and second engagement portions 33 and 34 are configured to engage so that the engaged portions are slidable in the vertical or Z direction, as will be described in detail later. Furthermore, the carriage 19 has a lower end provided with a slidable contact 35 which is configured to retain an attitude of the cutting head 5, that is, to prevent rotation of the cutting head 5, as will also be described in detail later.

The drive mechanism 36 is constructed as follows. A cranked mounting plate 37 is mounted on a left front of the carriage 19 as shown in FIGS. 3 to 7. A Z-axis motor 38 such as a stepping motor is mounted on a front of left end of the mounting plate 37 so as to be backwardly oriented. The Z-axis motor 38 has an output shaft to which a driving gear 39 having a small diameter is fixed. A gear shaft 40 is mounted on the mounting plate 37 so as to be located right above the Z-axis motor 38 and so as to extend frontward. A driven gear 41 having a large diameter and a pinion gear 42 are rotatable supported on the gear shaft 40. The driven gear 41 and the pinion gear 42 are formed integrally with each other and rotated together. The driven gear 41 is brought into mesh engagement with the driving gear 39.

A rack member 43 is provided on the right of the gear shaft 40. The rack member 43 is shaped so that a left wall leads toward a front wall and extends vertically. The rack member 43 is supported on a shall 46 so as to he vertically movable. The shall 46 will be described later. The rack member 43 has a left wall surface formed with a vertically extending rack portion 43*a* with which the pinion gear 42 is in mesh engagement. As the result of the foregoing construction, the Z-axis motor 3$ is driven to rotate the pinion gear 42, thereby vertically moving the rack member 43.

Figure 7:
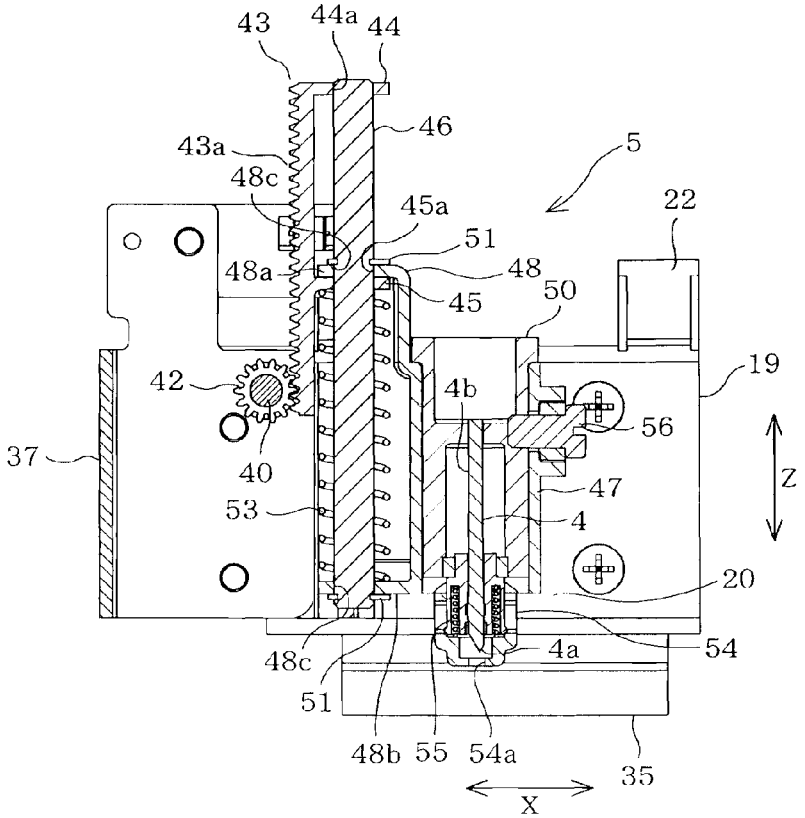
FIG. 7 is a longitudinally sectional front view taken along line VII-VII in FIG. 2.
Figure 8:
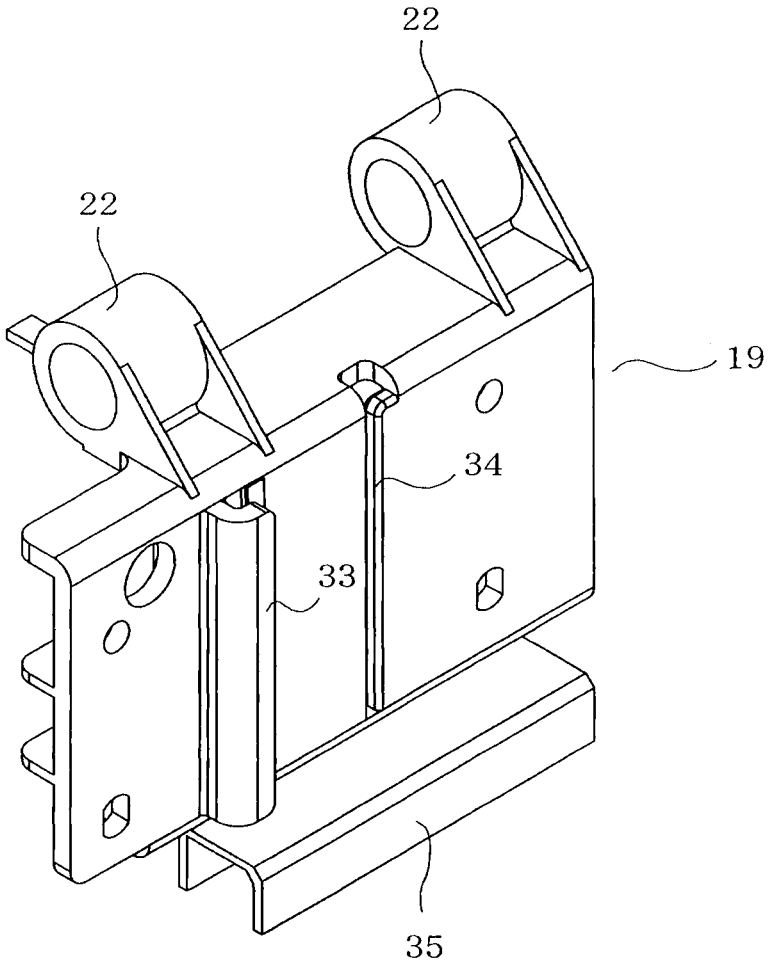
FIG. 8 is a perspective view of a carriage.

The rack member 43 has a thin plate-like upper support piece 44 formed integrally on an upper surface thereof as shown in FIG. 7. A plurality of horizontal thin plate-like middle support pieces 45 is mounted on a vertically middle part and a slightly lower part of the inner surface of the rack member 43 respectively though only the middle support piece 45 located on the vertically middle of the rack member 43 is shown in FIG. 7. The middle support pieces 45 are formed integrally with the rack member 43. The upper and middle support pieces 44 and 45 are formed with respective through holes 44*a* and 45*a*. A vertically long round bar-like shall 46 is inserted through the holes 44*a* and 45*a* and disposed in the rack member 43 so as to he movable upward and downward.

Figure 5:
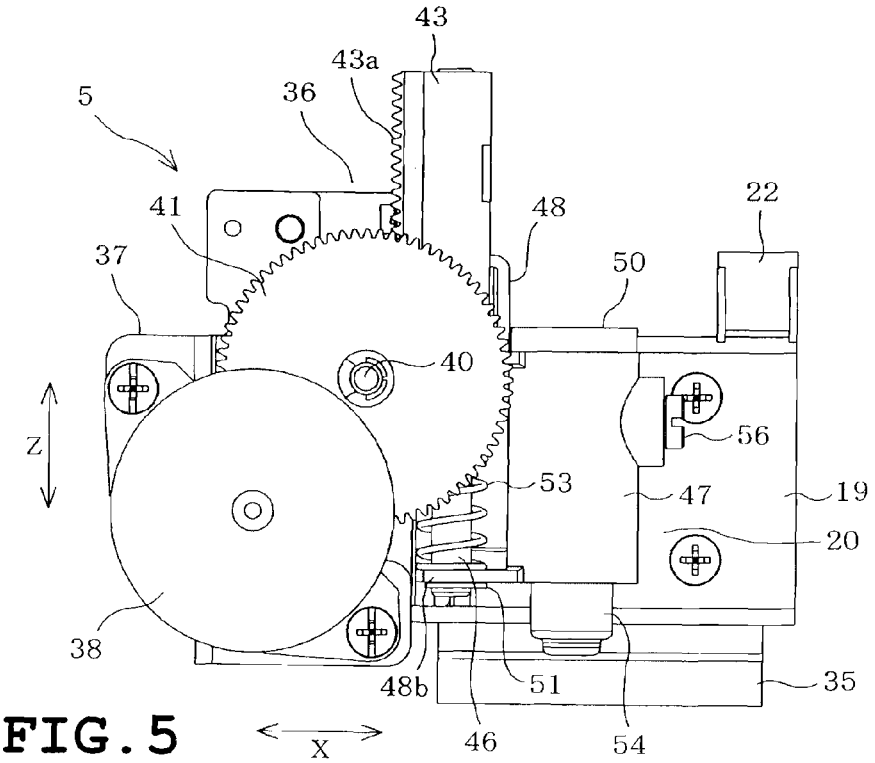
FIG. 5 is a front view of the cutting head.
Figure 6:
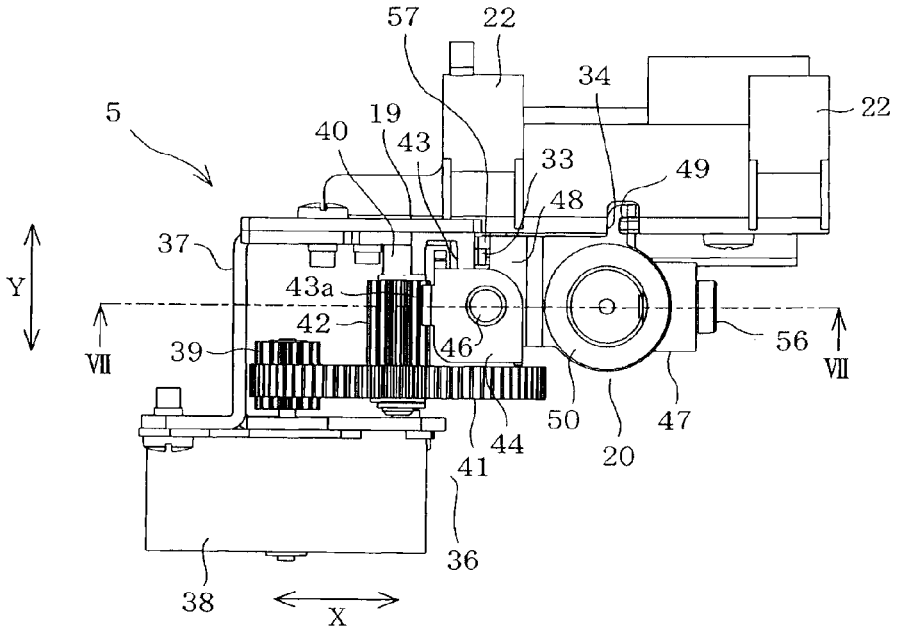
FIG. 6 is a plan view of the cutting head.

The cutter holder 20 includes a mounting cylindrical portion 47, a shall support 48, a first engaged portion 57 and a second engaged portion 49 (shown in only FIG. 6) all formed integrally therewith, as shown in FIGS. 4 to 7. The mounting cylindrical portion 47 is formed into a vertically extending cylindrical shape, and a cutter support cylinder 50 having the cutter 4 is detachably attached to the mounting cylindrical portion 47, as will he described later. The first engaged portion 57 is located in the rear of the shall 46 so as to vertically extend. The first engaged portion 57 is in engagement with the first engagement portion 33 of the carriage 19. The second engaged portion 49 is generally formed into an L-shape in a planar view and mounted on a rear side of the mounting cylindrical portion 47 so as to extend vertically, as shown in FIG. 6. The second engaged portion 49 engages the second engagement portion 34 of the carriage 19 so as to be vertically movable. As the result of the foregoing construction, the cutter holder 20 is movable between a lowered position where a blade edge 4*a* of the cutter 4 passes through the cutting object 6 as will be described later and a raised position where the blade edge 4*a* is spaced away from the cutting object 6 by a predetermined distance.

The shall support 48 is located on the left side of the mounting cylindrical portion 47 and has an upper plate 48*a* and a lower plate 48*b*, as shown in FIG. 7. The upper and lower plates 48*a* and 48*b* are formed with circular through holes 48*c* through which the shaft 46 extends, respectively. The upper plate 48*a* is disposed so as to overlap an upper surface of one of the middle support pieces 45. Retaining rings 51 are locked to a slightly upper part of the vertically middle and a lower end of the shaft 46, whereby the shaft 46 is mounted to the shaft support 48. A compression coil spring 53 is provided around the shaft 46 so as to be located between the underside of the middle support piece 45 and the upper surface of the lower plate 48*b*. This results in upward or downward movement of the shaft support 48, that is, the cutter holder 20 with upward or downward movement of the rack member 43. In this case, the cutter holder 20 is moved between the lowered position where the blade edge 4*a* passes through the cutting object 6 and the raised position where the blade edge 4*a* is spaced away from the cutting object 6 by the predetermined distance.

The following describes in detail the operation of the cutting plotter 1 in the case where the cutter holder 20 is to be lowered. The cutter holder 20 is gradually lowered with the downward movement of the rack member 43. On one hand, the cutter holder 20 is stopped at a position where the blade edge 4*a* of the cutter 4 has penetrated the cutting object 6. On the other hand, only the rack member 43 is continuously lowered. The rack member 43 is stopped after downward movement by a predetermined distance. More specifically, when the cutter holder 20 assumes the lowered position, the compression coil spring 53 is compressed downward by a predetermined distance by the middle support piece 45 of the rack member 43. As a result, a predetermined cutter pressure, that is, a force by which the cutter 4 presses the cutting object 6 is obtained from an elastic biasing force of the compression coil spring 53. On the other hand, an upward movement of the cutter holder 5 and that is, the cutter 4 is allowed against the biasing force of the compression coil spring 53.

The cutter support cylinder 50 is formed into a vertically long cylindrical shape such that an outer periphery thereof is fitted with the inner periphery of the mounting cylinder 47, as shown in FIG. 7. The cutter 4 is mounted on the cutter support cylinder 50 so as to be an extension at a central axis of the cutter support cylinder 50. The cutter 4 has a lower end that is a distal end of the cutter shaft 4*b* and is provided with the blade edge 4*a*. The blade edge 4*a* protrudes downward from the lower end of the cutter support cylinder 50. A cylindrical cap-like pressing portion 54 is mounted to the lower part of the cutter support cylinder 50 so as to be movable upward and downward and so as to cover the blade edge 4*a*. A coil spring 55 as shown in FIG. 7 is disposed between the pressing portion 54 and the cutter support cylinder 50 in order to normally bias the pressing portion 54 downward. The pressing portion 54 has a central underside formed with a through hole 54*a* through which the blade edge 4*a* of the cutter 4 is passable.

The cutter support cylinder 50 is fitted into the mounting cylinder 47 from above and fixed in position by a screw 56. As a result, the cutter 4 is moved upward and downward by the drive mechanism 36 while being supported by the cutter holder 20 and accordingly the cutter support cylinder 50. The cutter 4 assumes the raised position normally or during a non-cutting time and the blade edge 4*a* thereof is covered by the pressing portion 54 so as not to be exposed, as shown in FIGS. 5 and 7.

When the cutter holder 20 and accordingly the cutter support cylinder 50 are moved downward by the drive mechanism 36, the underside of the pressing portion 54 is firstly brought into contact with the upper surface of the cutting object 6, whereby further downward movement of the pressing portion 54 is disallowed. The cutter holder 20 and accordingly the cutter 4 are further moved downward against the spring force of the coil spring 55, whereby the blade edge 4*a* reaches the lowered position where the blade edge 4*a* passes through the hole 54*a* of the pressing portion 54 and further penetrates the cutting object 6 thereby to cut the cutting object 6. In this state, the holding sheet 10 is moved freely in the Y direction by the conveying mechanism 7 arid the cutting head 5 is moved freely in the X direction by the cutter moving mechanism 8 in synchronization with the movement of the holding sheet 10.

The slidable contact 35 is disposed on the lower end of the carriage 19 to maintain an attitude of the cutting head 5, that is, to retain the guide shaft 21, as described above. The slidable contact 35 generally has a U-shape and is downwardly directed as viewed at a side, as shown in FIGS. 3 to 8. The slidable contact 35 is further formed into the shape of a thin plate extending in the right-left direction. Accordingly, the slidable contact 35 is formed so that a right-left dimension thereof is longer than a front-back dimension thereof. The right-left direction is parallel to the guide shaft 21 and the front-back direction corresponds to the conveying direction.

The slidable contact 35 has an inner surface which slidably contacts the pinch roller shaft 13 provided in the conveying mechanism 7 thereby to maintain an attitude of the carriage 19 while allowing the carriage 19 to be moved in the X direction, as shown in FIG. 3. Accordingly, the slidable contact 35 and the pinch roller shaft 13 are disposed at respective positions that are adjacent to each other with respect to the conveying direction or the V direction.

In this case, since the pinch roller shaft 13 is supported so as to be displaceable in the direction of thickness of the cutting object 6 or a vertical direction as described above, the slidable contact 35 is in sliding contact with the pinch roller shall 13 so as to he relatively movable in the direction of displacement of the pinch roller shall 13 or in the vertical direction. Furthermore, the slidable contact 35 is formed into such a shape as to sandwich the pinch roller shaft 13 between opposite side surfaces thereof in the conveying direction of the cutting object 6, that is, in the front-back direction. The slidable contact 35 is moved in a part of the pinch roller shaft 13 between the rollers 13*a* and 13*b*. In this case, it is needless to say that the slidable contact 35 does not affect moving range of the carriage 19 and accordingly the cutting head 5 in the X direction.

Figure 9:
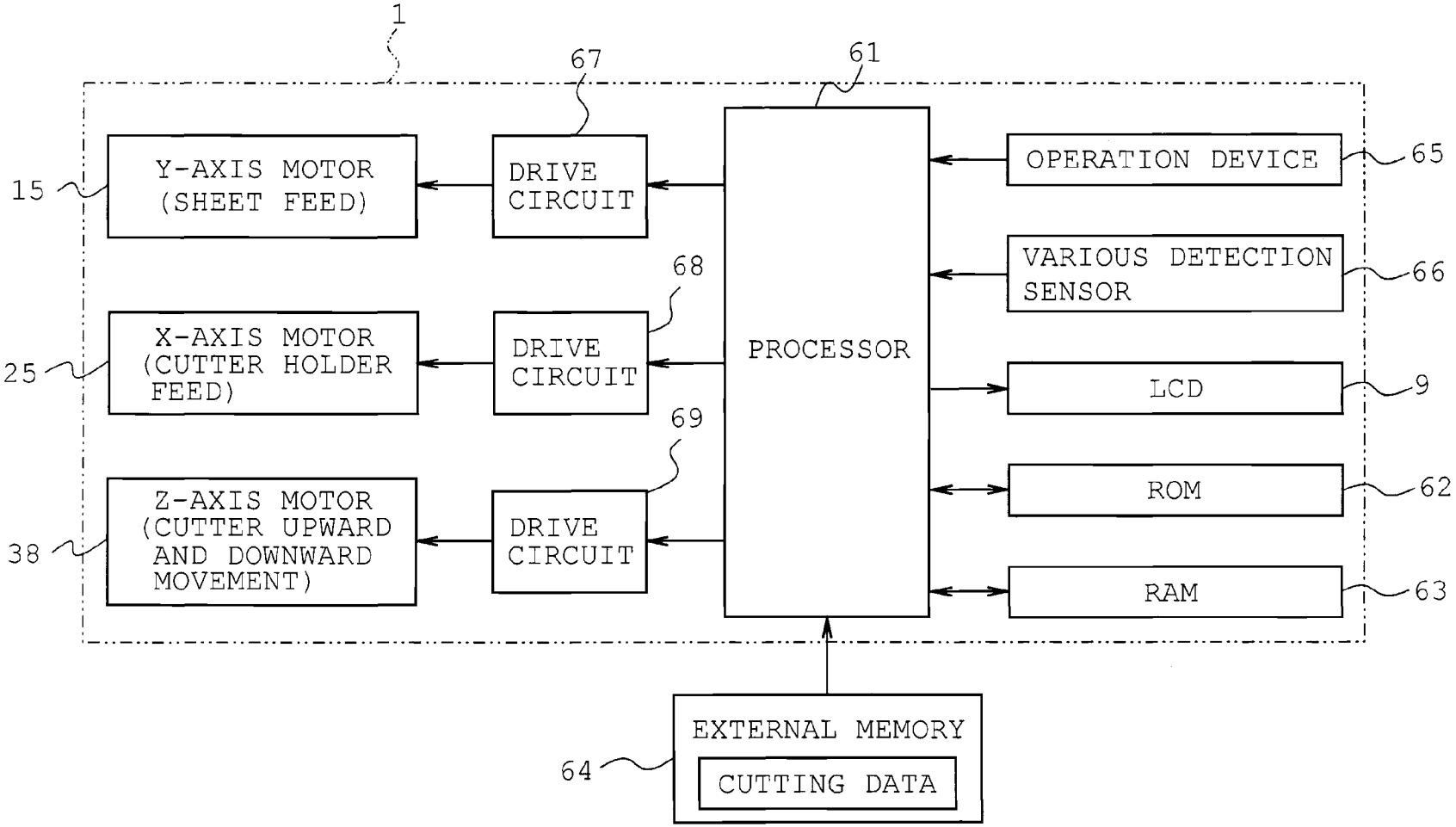
FIG. 9 is a schematic block diagram showing an electrical arrangement of the cutting plotter.

The configuration of the control system of the cutting plotter 1 will be described with reference to FIG. 9. A processor 61 controlling the entire cutting plotter 1 is mainly constituted by a computer or a CPU. To the processor 61 are connected a ROM 62, a RAM 63 and an external memory 64. The ROM 62 stores a cutting control program for controlling the cutting operation, a display control program for controlling the display 9, and the like. The RAM 63 temporarily stores various data and programs to execute each processing.

To the processor 61 are connected various operation switches of the operation device 65, the detection sensor 66 and the display 9. The display 9 is configured to display a pattern selecting screen, an arrangement setting screen and the like. While viewing the screen of the display 9, the user operates one or more of the operation switches of the operation device 65 to select a desired pattern or to set a cutting position. Furthermore, to the processor 61 are further connected drive circuits 67, 68, 69 and 70 driving the Y-axis motor 15, the X-axis motor 25 and the 7-axis motor 38 respectively. The processor 61 executes the cutting control program to control the Y-axis motor 15, the X-axis motor 25 and the 7-axis motor 38, whereby a cutting operation is automatically carried out for the cutting, object 6 on the holding sheet 10.

The external memory 64 stores cutting, data for cutting a plurality of types of patterns by the cutting plotter 1. The cutting data includes basic size information, cutting line data and display data. The basic size information includes values indicative of horizontal and vertical sizes of patterns and accordingly is shape data. The cutting line data includes data of X-Y coordinate values indicative of apexes of a cutting line composed of a plurality of line segments and is defined by the X-Y coordinate system of the cutting plotter 1. When the pattern is to he cut relative to the cutting object 6, the processor 61 controls the conveying mechanism 7 based on the cutting data of the selected pattern, that is, the cutting line data when the pattern is to be cut relative to the cutting object 6, thereby moving the holding sheet 10 and accordingly the cutting object 6 in the Y direction. The cutting head 5 and accordingly the cutter 4 are moved in the X direction by the cutter moving mechanism 8 in synchronization with the above-described movement of the cutting object 6, whereby the cutting object 6 is cut along the contour line or the pattern.

The above-described cutting plotter 1 of the configuration will work and have advantageous effects as follows. More specifically, in the above-described construction, the carriage 19 of the cutting head 5 is moved in the X direction by the cutter moving mechanism 8 while sliding on the guide shaft 21, as shown in FIG. 3. In this case, the slidable contact 35 provided on the cutting head 5 is brought into contact with the pinch roller shaft 13 extending substantially in parallel, to the guide shaft 21, thereby being slid. As a result, the attitude of the cutting head 5 is retained and the rotation of the guide shaft 21 is prevented. Accordingly, the configuration to retain the attitude of the cutting head 5 can be simplified, and guide members to prevent rotation of the guide shaft 21 need not be provided with the result that a space saving effect can be achieved.

The pinch roller shaft 13 is provided so as to be displaceable in the vertical direction relative to the housing 11, so that the vertical position of the pinch roller shaft 13 is displaced by the thickness of the cutting object 6, for example. In the configuration, the slidable contact 35 is in sliding contact with the pinch roller shaft 13 so as to be relatively movable in the direction of displacement of the pinch roller shalt 13. This can stabilize and retain the attitude of the cutting head 5 even when the pinch roller shaft 13 is vertically displaced. Moreover, the slidable contact 35 is formed into such a shape as to sandwich the pinch roller shaft 13 between opposite side surfaces thereof in the conveying direction of the cutting object 6, that is, into an inverted U-shape sandwiching the pinch roller shaft 13 in the front-back direction. Consequently, the shape of the slidable contact 35 can highly he simplified.

In the foregoing configuration, the pinch roller shall 13 is employed as a roller shaft which is brought into sliding contact with the slidable contact 35. A driving, roller or any other rotatable roller shaft that is brought into contact with the cutting object thereby to feed the cutting object, or the like may be employed, for example. Furthermore, various modified forms may be considered as the configuration and shape of the slidable contact, including a C-shaped or cylindrical side surface. Still furthermore, various changes may be possible in the conveying mechanism, a concrete construction of the cutting head and an overall hardware configuration of the cutting plotter. Thus, the foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

What is claimed is:

1. A cutting plotter comprising:

a housing;

a conveying mechanism configured to convey a sheet-like cutting object in a first direction, the conveying mechanism being provided with one roller shaft extending in a second direction intersecting with the first direction and a driving roller, the roller shaft being provided with two rollers located at different positions in the second direction, the conveying mechanism being configured to convey the object while the object is held between the rollers and the driving roller;

a guide shaft extending in the second direction parallel to the roller shaft and connected to the housing;

a cutting head slidably supported by the guide shaft and being configured to be mounted with a cutter;

a cutter moving mechanism configured to move the cutting head along the guide shaft; and a slidable contact provided in the cutting head and contacting the roller shaft between the rollers of the roller shaft so as to be slidable in a region between the rollers of the roller shaft, thereby maintaining a position of the cutting head, the slidable contact having a U-shaped cross section, the roller shaft being disposed at an open side of the U-shape, the slidable contact being disposed at a side oppose to the driving roller with the roller shaft being interposed therebetween.

2. A cutting plotter according to claim 1, wherein the slidable contact has a first surface and a second surface facing to the first surface, wherein the first surface is provided in one side of the roller shaft in the first direction, and wherein the second surface is provided in the other side of the roller in the first direction.

3. A cutting plotter according to claim 1, wherein the driving roller is provided in one side of the roller shaft in a third direction perpendicular to both the first direction and the second direction, and wherein the slidable contact is provided in the other side of the roller shaft in the third direction to embrace the roller shaft.

4. A cutting plotter according to claim 1, wherein the slidable contact has a first size in the first direction and a second size in the second direction, wherein the second size is greater than the first size.

5. A cutting plotter according to claim 1, wherein the slidable contact and the roller shaft are provided in the same position in the first direction.

6. A cutting plotter according to claim 5, wherein the housing has an aperture formed in one side with respect to the both the slidable contact and the roller shaft in the first direction, and wherein the guide shaft is provided in the other side with respect to the both the slidable contact and the roller shaft in the first direction.

* * * * *